United States Patent [19]

Bucher

[11] 4,022,251

[45] May 10, 1977

[54] JACQUARD MACHINE HAVING RECIPROCATING GRIFFES AND LIFTING WIRES

[75] Inventor: Robert Bucher, Winterthur, Switzerland

[73] Assignee: Sulzer Brothers Limited, Winterthur, Switzerland

[22] Filed: Jan. 20, 1976

[21] Appl. No.: 650,697

[30] Foreign Application Priority Data

Jan. 31, 1975 Switzerland ..... 1202/75

[52] U.S. Cl. ..... 139/59; 139/65

[51] Int. Cl.[2] ..... D03D 3/00; D03D 3/08

[58] Field of Search ..... 139/59–65, 139/85

[56] References Cited

UNITED STATES PATENTS

| | | | |
|---|---|---|---|
| 3,884,272 | 5/1975 | Brenner et al. | 139/59 |

FOREIGN PATENTS OR APPLICATIONS

| | | | |
|---|---|---|---|
| 2,032,182 | 11/1970 | France | 139/65 |
| 236,111 | 6/1911 | Germany | 139/59 |
| 622,112 | 11/1935 | Germany | 139/59 |
| 284,230 | 5/1916 | Germany | 139/65 |

*Primary Examiner*—James Kee Chi

*Attorney, Agent, or Firm*—Kenyon & Kenyon Reilly Carr & Chapin

[57] ABSTRACT

The griffes are provided with projecting means on two sides in order to guide the drive nebs on the lifting hooks during shifting of the lifting hooks. The two means are of different length with one acting as a pressing ledge to guide a lifting hook onto a neb of an adjacent griffe while the other acts as a guide ledge to block movement of a lifting hook onto an adjacent griffe.

7 Claims, 4 Drawing Figures

JACQUARD MACHINE HAVING RECIPROCATING GRIFFES AND LIFTING WIRES

Figure 1:
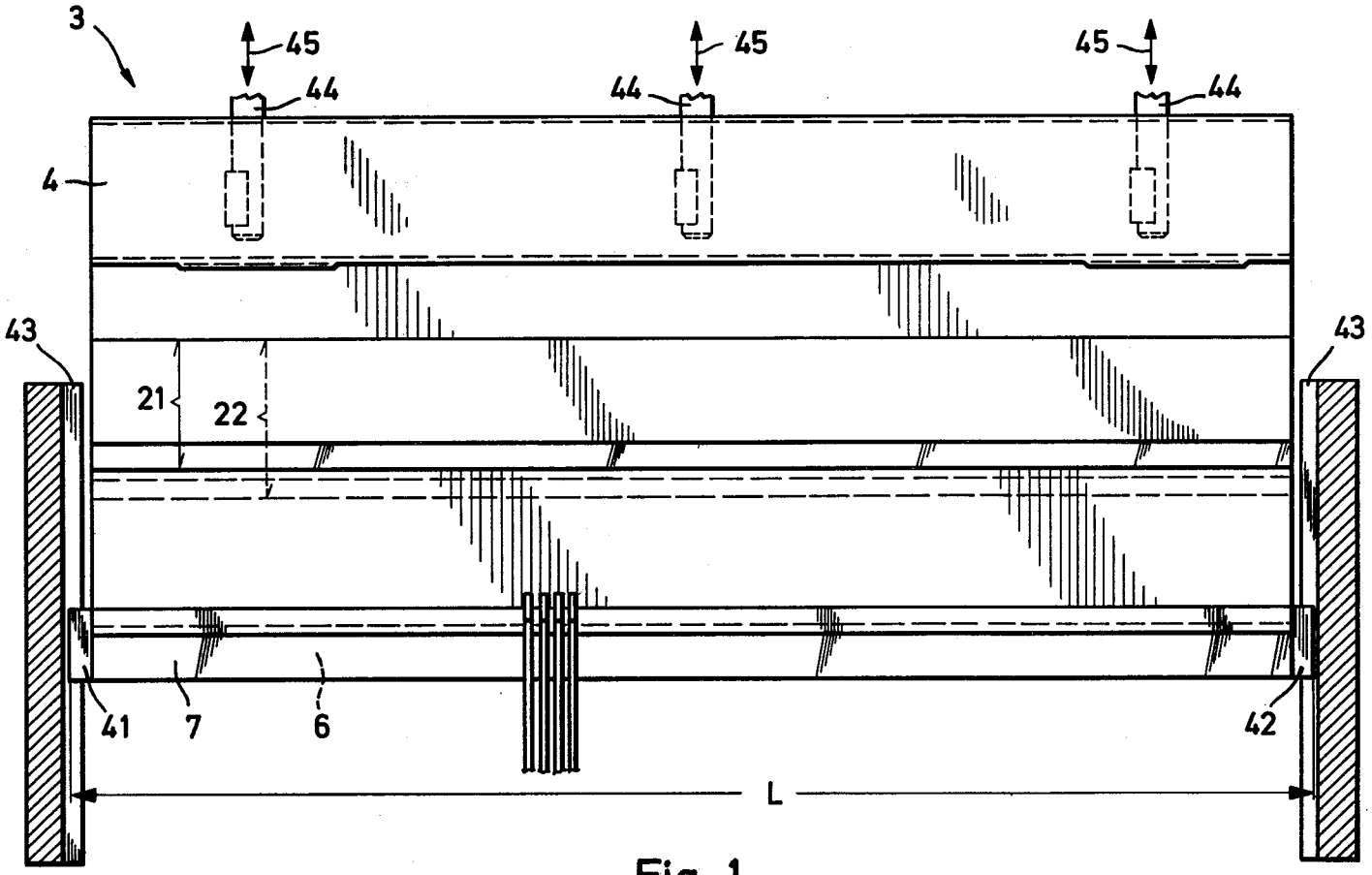

This invention relates to a jacquard machine having reciprocating griffes and lifting hooks.

As is known, jacquard machines generally have reciprocating griffes which are provided with hooks for driving lifting hooks which are controlled by jacquard needles and which, in turn, have nebs engageable with the griffe hooks. In known machines of this kind as disclosed by Swiss Patent No. 552,691, the lifting hooks are pressed, i.e. shifted, in a central zone — pressing zone — by pressing needles, i.e. jacquard needles which move transversely of the lifting hooks so that the lifting hooks are moved into and out of engagement with stationary stop members, such as top and bottom blades. However, since the points at which the lifting-hooks are engaged by the pressing needles are at an appreciable distance above or below the associated nebs, the actual distance depending upon the construction of the jacquard machine, the lifting hook nebs often vibrate in operation. As a result, engagement of a lifting hook with an associated griffe during the pressing movement produced by the jacquard needles become unreliable and the lifting hook is not moved by the griffe, i.e. raised, for instance, as required by the weave program. The lifting hooks also experience distortion in operation, so that their engagement with the griffes becomes uncertain.

Accordingly, it is an object of the invention to provide a jacquard machine in which the engagement between a lifting hook and a griffe is assured.

It is another object of the invention to provide a griffe for a jacquard machine of simple construction which is able to effect a reliable engagement with a lifting hook according to a weave program.

The projecting means thus guides the hooks to control their engagement with a fixed blade or a blade of another griffe. The effect is one which increases the reliability with which the lifting hooks engage with the blades of the jacquard.

Briefly, the invention provides a griffe which has a blade for engaging a lifting hook in a jacquard machine and a pair of oppositely disposed projecting means, one of which is disposed on the same side as the blade. These projecting means each form an elongated surface longitudinally of the griffe with one surface being longer than the other surface.

These griffes cooperate with a plurality of lifting hooks, each of which has a drive neb, and a plurality of jacquard needles, each of which is positioned to press against a respective lifting hook within a pressing zone of the lifting hook. The two surfaces of each griffe are further located in a zone which is opposite the nebs of adjacent lifting hooks during pressing for guiding the adjacent lifting hook in the part near the neb. Consequently, while the jacquard needles are pressing on the central pressing zone of a lifting hook, the nebs of the lifting hook are also shifted reliably and engaged with the adjacent griffe.

Another effect which can be obtained is to have the projecting means override the effect of the presser mechanism of the jacquard at least as to the part of the lifting hook which engages the projecting means. For example, the lifting hook may be arranged so that the upper position will always be engaged by a rising griffe while the presser mechanism controls the engagement of the hook within other fixed blades as the griffe descends.

Because the projecting means increases the reliability of engagement between the lifting hooks and the griffes, a sinusoidal griffe motion may be used when this would not otherwise be possible.

Figure 2:
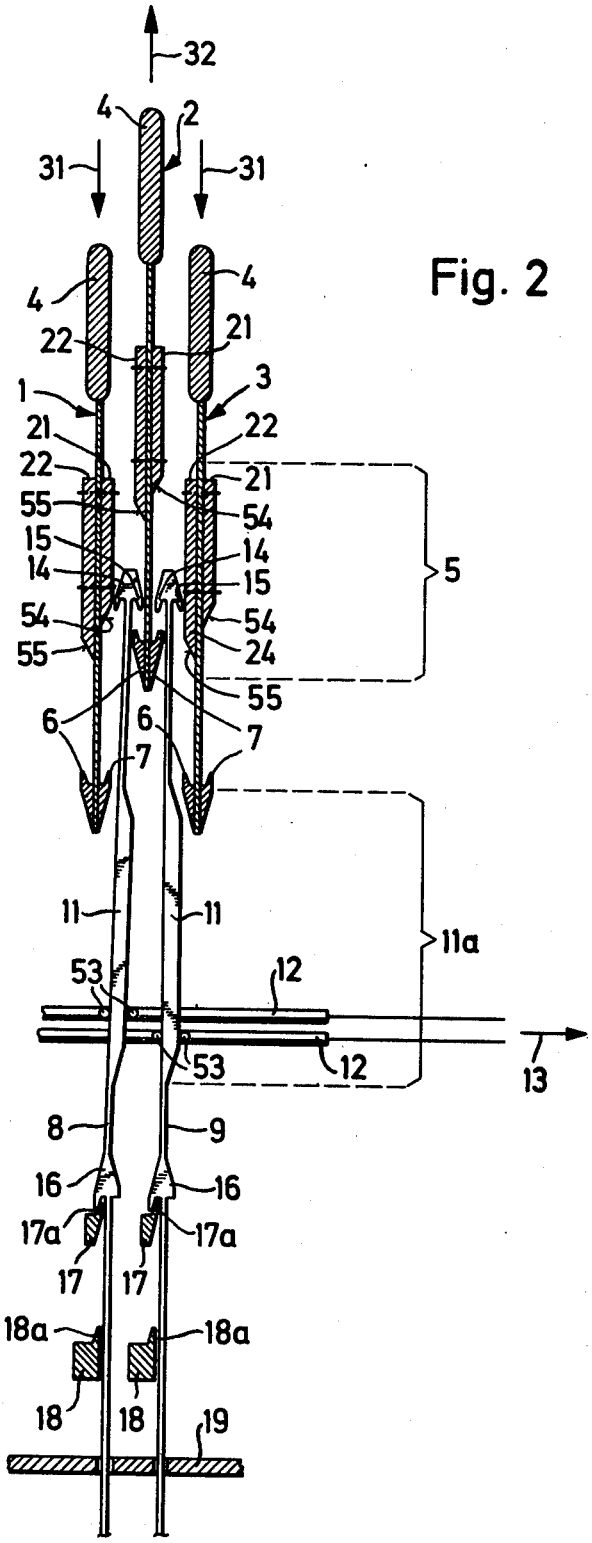
Figure 3:
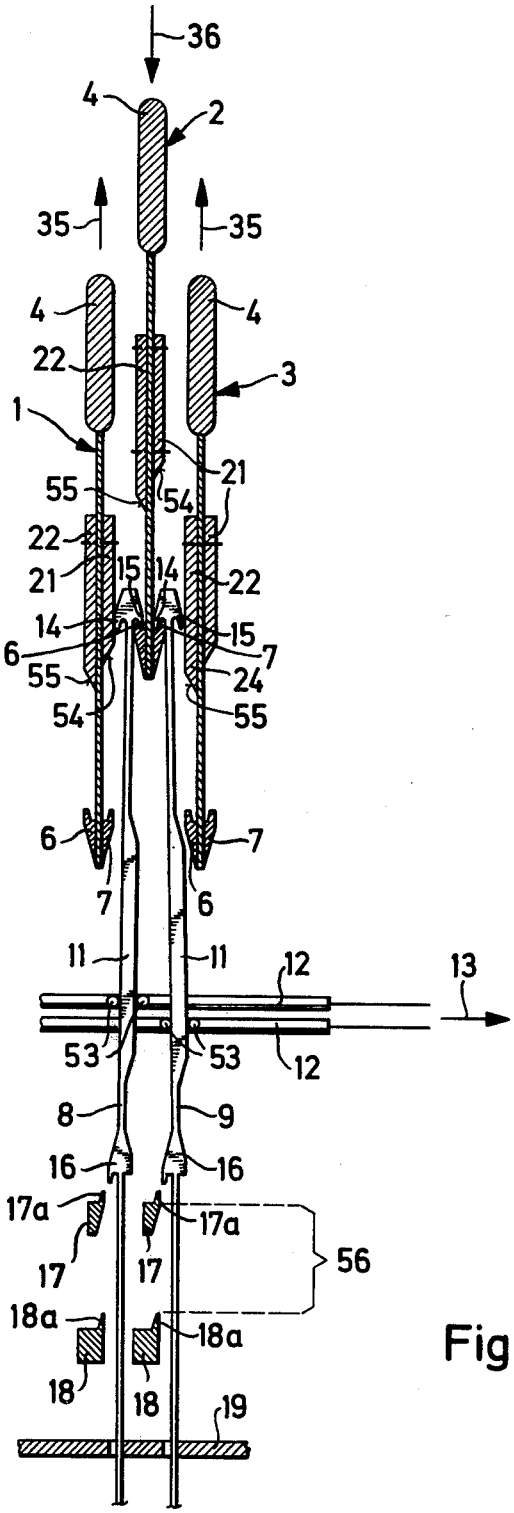
Figure 4:
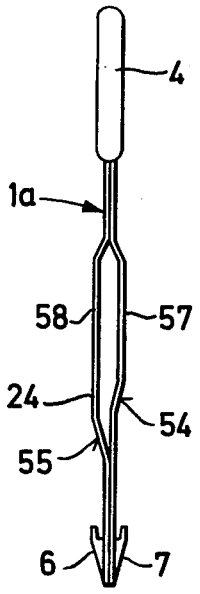

These and other objects and advantages of the invention will become more apparent from the following detailed description and appended claims taken in conjunction with the accompanying drawings in which FIG. 1 illustrates a view in front elevation of a griffe of a double-lift jacquard machine having single lifting wires in accordance with the invention;

FIGS. 2 and 3 each illustrate various positions of the griffes and lifting wires according to the invention; and FIG. 4 illustrates a modified griffe according to the invention.

Referring to FIGS. 1 to 3, a jacquard machine is provided with a plurality of griffes, 1, 2, 3 each of which is of a length L and has a top beam 4 and a pair of oppositely disposed projecting means, such as ledges or strips 21, 22 on opposite sides. Each griffe has a double blade 6, 7 on the bottom end and ends 41, 42 which are guided in stationary comb-like guides 43 on the machine frame. Each elongated griffe 1 — 3 is driven by means of three riser bars 44 and is adapted to reciprocate vertically as indicated by double arrows 45 in FIG. 1. The remainder of the drive for the griffes may be of any suitable structure, for example as described in U.S. patent application Ser. No. 650,770, filed Jan. 20, 1976.

Referring to FIG. 2, each of the three griffes 1, 2, 3 has a central flat zone 5 (given a reference only in the case of the right-hand griffe 3) and at the bottom end a double blade 6, 7. The griffes l, 3 are shown in positions in which they are just about to descend (arrow 31) and the griffe 2 is shown in a position in which it is just about to rise (arrow 32).

A pair of lifting hooks 8, 9 are disposed between the griffes 1, 2, 3 and are permanently biased downwardly by a spring or weight lingoes. Each lifting hook 8, 9 is stiffened in the central zone 11*a* (FIG. 2) by a widening 11 (reinforcement). The zone 11*a* represents a pressing zone where jacquard needles 12 are operative, in the direction indicated by an arrow 13, on the lifting hooks 8, 9 to press the hooks 8, 9 to the right as viewed in FIG. 2 (in FIGS. 2 and 3 the hooks 8, 9 and needles 12 are shown in the pressed position, i.e. in the position which is to the right in the drawings). To this end, the needles 12 have two pins or studs or the like 53 each on both sides of the lifting hooks 8, 9 for abutting the hooks. The lifting hooks 8, 9 each have drive nebs 14, 15 at the top which are selectively engageable in the blades 6, 7 of the griffes 1 – 3. Also, each lifting hook 8, 9 has an open-shed neb 16 adapted to engage with a stationary open-shed blade 17 or with a stationary bottom blade 18. At their bottom ends, the lifting hooks 8, 9 extend through a perforate plate or bottom board 19 and are secured to harness cords (not shown) and healds for the warp yarns of a weaving machine which are suspended below the plate 19.

Referring to FIG. 2, the two strips 21, 22 on each griffe 1, 2, 3 are of different length and are mounted intermediately of the griffe to form elongated surfaces longitudinally of the griffe. As shown, the strips 21, 22 each have an inclined surface 54, 55 at the lower end. In addition, one strip 21 acts as a pressing ledge as described below and extends in the direction of the pressing movement of the needles 12 while the other strip 22 acts as a guide ledge as described below for the adjacent lifting hooks 8, 9 and extends in the opposite direction.

The pressing ledges 21 are secured, e.g. by screwing, to that side of the griffes 1 – 3 which corresponds to the pressing movement in the direction indicated by arrow 13. The guide ledges 22 are secured on the opposite side. The pressing ledges 21 are shorter than the guide ledges 22 so that the guide ledges 22 are lengthened at their bottom end 24 relative to the ledges 21. The reason for this feature is that the guidance provided by the guide ledge 22 must start earlier in time than the pressing provided by the pressing ledge 21, referred to a consistent instant of time, which is the same for all the lifting hooks 8, 9, undergoing a pressing movement produced by the jacquard needles 12. Thus, the nebs 14, 15 need not be moved to the right during the pressing movement of the needles 12 and then moved to the left, but rather can remain in the left-hand position if the hook 9 is pressed by a needle 12.

As a rule, the strips 21, 22 extend over the whole length L of the griffes 1 – 3 as shown in FIG. 1, the length L extending perpendicularly to the plane of the drawings. In special cases, the strips 21, 22 may extend over only a portion of the total length of the griffes. Further, some griffes may have only a single strip, e.g. the guide ledge 22.

The strips 21, 22 should be fitted to a griffe in the zone 5 into which the lifting hook nebs 14, 15 move during the pressing operation relative to the descending griffes.

The strips 21, 22 can be made e.g. of plastics or a metal material.

Referring to FIG. 4, the projecting means of a griffe may also be formed by bent members 57, 58.

The jacquard machine operates as follows:

Referring to FIG. 2, when the griffes 1, 3 descend, the pressing zone 11a of the lifting hook 8 is deflected to the right as viewed to disengage the neb 16 from the hook 17*a* on the blade 17. The pressing ledge 21 on the descending griffe 1 runs on the neb 14 of the lifting hook 8 by way of the inclined surface 54 and holds the hook 8 in the right-hand position in a form-locking manner, so that neb 15 is engaged with a blade 6 of the rising griffe 2. The neb 14 of the adjacent lifting hook 9, however, cannot move to the right although its zone 11*a* is deflected by the particular jacquard needle 12 concerned due to the presence of the pressing ledge 22 on the griffe 3. The lifting hooks 8, 9 are then engaged in the rising griffe 2 and raised thereby so that the nebs 16 are disengaged from the blades 17 with the two nebs 16 moving into the right-hand position. The parts then move into their top deadcenter position as is known.

During the next descent of the griffe 2, shown in FIG. 3 and indicated by an arrow 36, the lifting hooks 8,9 can move into a closed-shed position, the nebs 16 passing by the blades 17 on the right. While the nebs 16 are in the zone 56, the pressure in the direction indicated by the arrow 13 ceases and the lifting hooks 8,9 and their nebs 16 return to the initial position (not shown) which is the left-hand position in the drawings. Consequently, the nebs 16 are engaged in the hooks 18a of the stationary bottom blades 18.

In the following operation lifting wire 8 may be lifted — if desired — either by the hook 7 of griffe 1 (without pressing operation by the corresponding needle 12) or by the hook 6 of griffe 2 (via pressing operation of needle 12). Lifting wire 9 may be lifted — if desired — either by the hook 7 of griffe 2 (without pressing operation by the corresponding needle 12) or by the hook 6 of griffe 3 (via pressing operation of needle 12).

What is claimed is:

1. A jacquard machine comprising a plurality of lifting hooks, each said lifting hook having a drive neb;

a plurality of jacquard needles, each said needle being positioned to press against a respective lifting hook within a pressing zone of said lifting hook; and a plurality of reciprocating griffes, each said griffe having a blade for engaging with a neb of a respective lifting hook and at least one projecting means, said projecting means being located opposite a neb of an adjacent lifting hook during pressing of said adjacent lifting hook for guiding of said opposed neb thereon.

2. A jacquard machine as set forth in claim 1 wherein each said griffe includes a pair of projecting means, one of said projecting means being a pressing ledge extending outwardly in the direction of pressing movement of said jacquard needles for pressing an adjacent lifting hook into a blade of an adjacent griffe and the other of said projecting means being a guide ledge extending in an opposite direction to guide an adjacent lifting hook.

3. A jacquard machine as set forth in claim 2 wherein said guide ledge is longer than said pressing ledge in the direction of said griffe blade.

4. A jacquard machine as set forth in claim 2 wherein said ledges extend across the whole length of said griffe.

5. A jacquard machine comprising a plurality of lifting hooks, each said lifting hook being a double neb;

a plurality of jacquard needles, each said needle being positioned to press against a respective lifting hook within a pressing zone of said lifting hook, a plurality of reciprocating griffes, each said griffe being disposed between a pair of adjacent lifting hooks and having a double blade for selectively engaging with said nebs of said adjacent lifting hooks, a first projecting means on one side facing one of said adjacent lifting hooks and a second projecting means on an opposite side facing the other of said adjacent lifting hooks, said first and second projecting means being positioned to guide said nebs of said adjacent lifting hooks thereon during transverse movement a central zone of each of said adjacent lifting hooks.

6. A jacquard machine as set forth in claim 5 wherein said first and second projecting means are located intermediately of each respective griffe and said double blade is located at one end of each respective griffe, and wherein said nebs of said lifting hooks are located at one end thereof.

7. A griffe having a double blade for engaging a lifting hook and a pair of oppositely disposed projecting means, each forming an elongated surface longitudinally of said griffe with one surface being longer than the other surface and being disposed on the same side as a respective blade of said double blade.

* * * * *